US008082683B1

(12) United States Patent
Munch et al.

(10) Patent No.: US 8,082,683 B1
(45) Date of Patent: Dec. 27, 2011

(54) STRAP WRAP

(76) Inventors: Mikako A. Munch, Los Altos Hills, CA (US); Yoshimi Munch, Los Altos Hills, CA (US); Mark Munch, Los Altos Hills, CA (US)

( * ) Notice: Subject to any disclaimer, the term of this patent is extended or adjusted under 35 U.S.C. 154(b) by 716 days.

(21) Appl. No.: 11/998,207

(22) Filed: Nov. 28, 2007

(51) Int. Cl.
*A43B 3/12* (2006.01)
*A43B 23/00* (2006.01)

(52) U.S. Cl. ..... 36/11.5; 36/136; 36/100

(58) Field of Classification Search ..... 036/11.5, 036/100, 101, 136
See application file for complete search history.

(56) References Cited

U.S. PATENT DOCUMENTS

| | | | | |
|---|---|---|---|---|
| 2,842,769 | A * | 7/1958 | Barnes | 2/22 |
| 3,011,281 | A * | 12/1961 | King | 36/11.5 |
| 4,697,362 | A * | 10/1987 | Wasserman | 36/136 |
| 4,775,310 | A | 10/1988 | Fischer | 425/308 |
| 4,794,028 | A | 12/1988 | Fischer | 428/100 |
| 4,872,243 | A | 10/1989 | Fischer | 24/442 |
| 5,260,015 | A | 11/1993 | Kennedy et al. | 264/167 |
| 5,315,740 | A | 5/1994 | Provost | 24/452 |
| 5,339,499 | A | 8/1994 | Kennedy et al. | 24/452 |
| 5,518,795 | A | 5/1996 | Kennedy et al. | 428/100 |
| 5,673,501 | A | 10/1997 | Mathews | 36/136 |
| 5,744,080 | A | 4/1998 | Kennedy et al. | 264/167 |
| 5,802,676 | A | 9/1998 | Tolan | 24/16 |
| 5,857,220 | A * | 1/1999 | Erny et al. | 2/244 |
| 6,115,948 | A | 9/2000 | Mitchell | 36/136 |
| 6,397,497 | B1 * | 6/2002 | McAtee | 36/54 |
| 6,769,204 | B1 * | 8/2004 | Phillips | 36/136 |
| 6,904,706 | B2 | 6/2005 | Jones et al. | 36/11.5 |
| 7,028,420 | B2 | 4/2006 | Tonkel | 36/100 |
| 7,089,691 | B1 | 8/2006 | Silvera | 36/132 |
| 2002/0121030 | A1 | 9/2002 | Coleman | 36/11.5 |
| 2004/0093765 | A1 * | 5/2004 | Baldwin | 36/101 |
| 2005/0223600 | A1 * | 10/2005 | Hunter et al. | 36/112 |

OTHER PUBLICATIONS

"Crochet Fun Fashion Flip Flop Sandals", by Melanie Schwear, 2007 www.associatedcontent.com.
"Flip Flop Bow Straps", www.teenagegirlclothing.com, 2 pages.
"Alex Flip 'Em Flops with 7 sets of Changeable Straps", www.amazon.com/Alex-Flip-Flops-Changeable-Straps, 8 pages.
"Peda Bella Cushioning Strap Strips", www.footsmart.com, 2 pages.
"Taccosling", www.shoecaresupplies.com.

* cited by examiner

*Primary Examiner* — Marie Patterson
(74) *Attorney, Agent, or Firm* — Haverstock & Owens LLP

(57) ABSTRACT

A detachable material wrapped around a strap of a footwear guards against blister formation, provides comfort and a softer feel against a foot, and to add aesthetic value. In one embodiment, the detachable material is a strip made of self-fastening material. In another plurality of loops. The detachable material is reusable and adjustable.

13 Claims, 5 Drawing Sheets

STRAP WRAP

FIELD OF THE INVENTION

The present invention relates to footwear with straps. More particularly, the present invention relates to a decorative and comfort enhancing strap wrap.

BACKGROUND OF THE INVENTION

Some footwear have straps. For instance, a sandal has one or more straps which extend from an inner side of the sandal to an outer side of the sandal. A so-called flip flop is a type of backless footwear with a Y-shaped strap. The Y-shaped strap passe's between the large first toe and the second toe, and passes over the top and around and past the sides of the foot. People wear sandals and flip flops for ease, comfort and fashion. Prior art sandals and flip flops suffer from a number of shortcomings. For example, the strap on the sandal and the Y-shaped strap on the flip flop can cause blisters on the foot where the strap rubs against the foot while walking or during wear. In addition, it is not possible to wear the same sandal or flip flop different ways.

The present invention addresses these limitations in the prior art.

SUMMARY OF THE INVENTION

It is an objective of the invention to provide an improvement to footwear having at least one strap to provide a means to enhance comfort and prevent formation of abrasions or blisters caused by the strap against the user's foot. In one aspect of the present invention, the footwear has a detachable material configured to wrap around at least a portion of one strap for optimal comfort. Preferably, the detachable material is used to guard against blisters or abrasion formation and to provide comfort and a softer feel against a foot. In addition, the wrap can also be applied for enhanced aesthetic value. Alternatively, the detachable material is to change an appearance of the footwear. In particular, a collection of wraps can be provided having various colors, patterns and textures or a combination of these aspects. In some embodiments, the footwear has a detachable decorative accessory that attaches to the detachable material. Preferably, the detachable material is reusable and adjustable.

In one embodiment, the detachable material is a strip made of a self-fastening material. Typically, the strip has a first end and a second end. A portion of the second end wraps around a section of the at least one strap and attaches to a portion of the first end. Preferably, the self-fastening material is a hook and loop material having hooks on a first side and loops on a second side. Velcro® is a well known brand of hook and loop material.

In another embodiment, the at least one strap is a Y-shaped strap and the detachable material is a band having a slit. A plurality of hooks are attached to a front side and a plurality of loops are attached to a back side of the band. Preferably, the band wraps around legs of the Y-shaped strap. The plurality of hooks and the plurality of loops are attached to the band such that the band could be fastened to itself without visibly displaying the plurality of hooks and the plurality of loops from a top view of the footwear and without the plurality of hooks and the plurality of loops rubbing against a foot.

In another aspect of the present invention, a method of wrapping a detachable strip to a footwear having at least one strap includes placing the detachable strip along an inner side of a section of the at least one strap, such that a first end of the detachable strip protrudes outwardly from a first edge of the at least one strap and a second end of the detachable strip protrudes outwardly from a second edge of the at least one strap. The method includes folding the first end on top of an outer side of the section of the least one strap, rolling the second end over to attach to the first end, unrolling, the second end by detaching the second end from the first end, unfolding the first end and repeating the above mentioned steps until the detachable strip is positioned on the at least one strap for optimal comfort and aesthetic value. In some embodiments, the method includes attaching a detachable decorative accessory to the detachable strip.

In another aspect of the present invention, a method of wrapping a detachable band to a footwear having a Y-shaped strap includes sliding the detachable band underneath legs of the Y-shaped strap. Preferably, the detachable band has a slit, a plurality of hooks and a plurality of loops coupled to a front side of the band and to a back side of the band. Preferably, the slit faces toward a top of the footwear and the front side faces down. The method includes pulling inwards a first bottom corner of the detachable band and a second bottom corner of the detachable band toward a middle of the footwear which creates a standing arch. The method also includes folding top sides of the detachable band over outside edges of the Y-shaped strap and, folding a bottom side of the detachable band over inside edges of the Y-shaped strap, and securing each of the plurality of hooks to each of the plurality of loops. Preferably, the step of securing includes attaching a first of the plurality of loops on a back side of a first slit corner to a fourth of the plurality of hooks on a front side of a second slit corner, attaching a second of the plurality of hooks at a bottom middle of the back side of the band to a third of the plurality of loops on a front side of the first slit corner, attaching a first of the plurality of hooks on a back side of the first bottom corner to a fourth of the plurality of loops on a front side of the first corner, and attaching a third of the plurality of hooks on a back side of the second bottom corner to a second of the plurality of loops on a front side of the second top corner. In some embodiments, the method includes attaching a detachable decorative accessory to the detachable band.

In yet another aspect of the present invention, a method of manufacturing a detachable cover for a footwear having a Y-shaped strap includes cutting a band from a piece of material, making a slit from a middle top of the band down to a center of the band, and placing a plurality of hooks and a plurality of loops on a back side of the band and on a front side of the band, thereby creating the detachable cover for the footwear having the Y-shaped strap. Preferably, the band is rectangular in shape. Typically, a width of the band is at least double a width of the Y-shaped strap. Preferably, the step of placing includes adhering a first of the plurality of hooks on a back side of the bottom corner, adhering a second of the plurality of hooks on a bottom middle of the back side of the band, adhering a third of the plurality of hooks on a back side of a second bottom corner, adhering a first of the plurality of loops on a back side of a first slit corner, adhering a second of the plurality of loops on a front side of a second top corner, adhering a third of the plurality of loops on a front side of the first slit corner, adhering a fourth of the plurality of hooks on a front side of a second slit corner, and adhering a fourth of the plurality of loops on a front side of a first top corner.

DETAILED DESCRIPTION OF THE INVENTION

In the following description, numerous details are set forth for purposes of explanation. However, one of ordinary skill in the art will realize that the invention can be practiced without the use of these specific details.

Figure 1A:
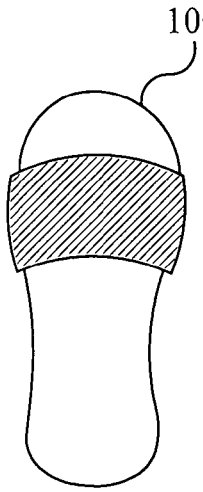
FIGS. 1A-1C illustrate different types of footwear with at least one strap.
Figure 1B:
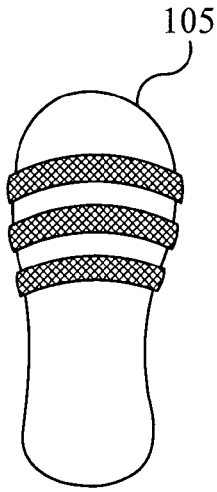
Figure 1C:
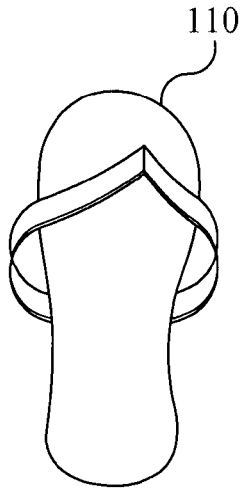

The present invention is directed toward a wrap for a footwear strap. FIGS. 1A-1C illustrate different types of footwear 100, 105, 110 with at least one strap. FIGS. 1A-B illustrate a sandal with one broad strap 100 and a sandal with 3 parallel straps 105, respectively, while FIG. 1C illustrates a footwear with a Y-shaped strap 110. Many different additions and variations of straps are possible on the footwear. The present invention is suitable for use with any configuration of footwear strap.

The footwear for which the present invention is adapted has at least one strap. A detachable material is configured to wrap around the at least one strap for optimal comfort and/or aesthetic value. Preferably, the detachable material is wrapped anywhere along the at least one strap. The detachable material is wrapped around a section of the at least one strap to guard against blister formation, abrasion or both, to provide comfort to a sore area on a foot, or to provide a softer feel against the foot, or both. Alternatively, the detachable material is wrapped around the section of the at least one strap to change an appearance of the footwear such that the same footwear can be worn different ways. Preferably, the detachable material is reusable and adjustable.

Figure 2A:
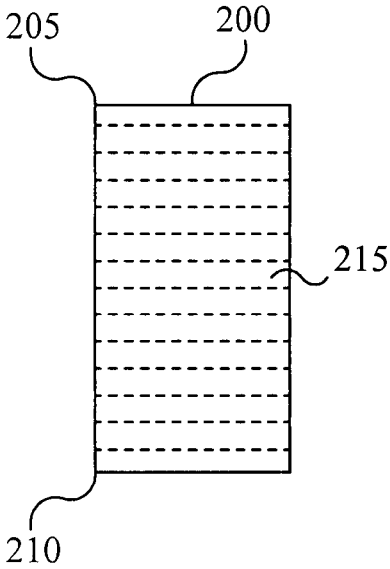
FIG. 2A illustrates a first side of a first embodiment of the present invention.
Figure 2B:
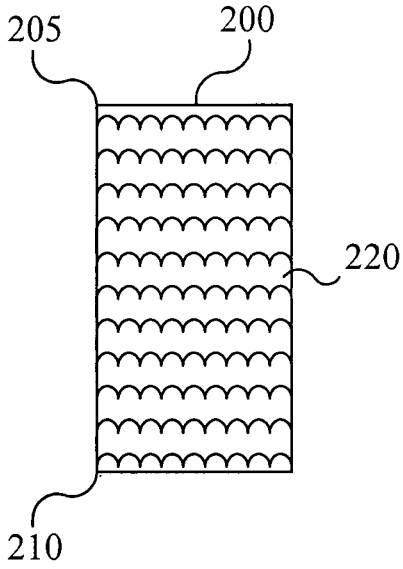
FIG. 2B illustrates a second side of the first embodiment of the present invention.

In one embodiment, the detachable material illustrated in FIGS. 2A-2B is a detachable strip 200 made of self-fastening material. The detachable strip has a first end 205 and a second end 210. A portion of the second end 210 wraps around the section of the at least one strap 225 and attaches to a portion of the first end 205. As discussed in detail below, the second end 210 is a looping end. Preferably, the self-fastening material has hooks on a first side 215 as illustrated in FIG. 2A and loops on a second side 220 as illustrated in FIG. 2B. Velcro® is a well known brand of hook and loop material. The self-fastening material typically has a thin profile.

Figure 2C:
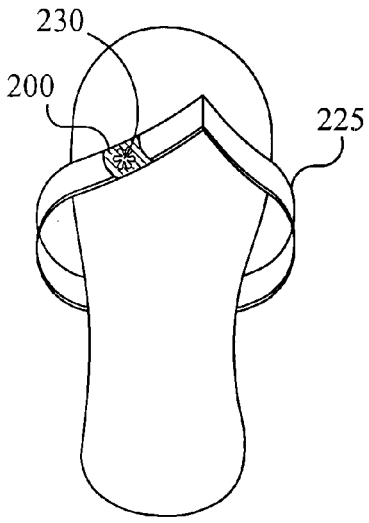
FIG. 2C illustrates a top down view of the first embodiment of the present invention attached to a footwear strap.
Figure 2D:
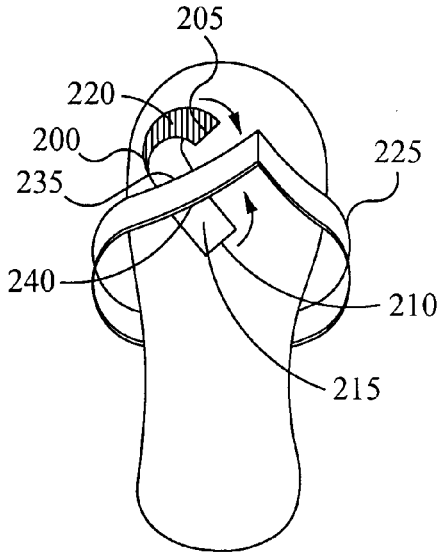
FIG. 2D illustrates a method of wrapping the first embodiment of the present invention around a footwear strap.

While FIG. 2C illustrates the detachable strip 200 wrapped around the at least one strap 225, FIG. 2D illustrates how the detachable strip 200 is typically wrapped around the section of the at least one strap 225. The detachable strip 200, preferably with the first side 215 up, is placed along an inner side of the section of the at least one strap 225, such that the first end 205 of the detachable strip 200 protrudes out from a first edge 235 of the at least one strap 225 and the second end 210 of the detachable strip 200 protrudes out from a second edge 240 of the at least one strap 225. The portion of first end 205 is folded on top of an outer side of the section of the least one strap 225, and the portion of the second end 210 is rolled over to attach to the portion of the first end 205, as indicated by arrows. As such, the second end 210 is the looping end. The detachable strip 200 can be removed by unrolling the portion of the second end 210, which detaches the portion of the second end 210 from the portion of the first end 205, and by unfolding the portion of the first end 205. The detachable strip 200 can be reattached by repositioning the detachable strip 200 on another section of the at least one strap 225 until optimal comfort is reached and/or aesthetic value is achieved.

Preferably, after wrapping the detachable strip 200 around the at least one strap 225, the second side 220 of the detachable strip 200 faces out. Typically, the loops on the second side 220 of the detachable strip 200 provide a soft feel against the foot, thereby providing comfort and guarding against blister formation caused by the at least one strap 225 rubbing against the foot while walking or during wear. In some embodiments, a plurality of detachable strips 200 can wrap around the at least one strap 225 to provide additional comfort. In other embodiments, the detachable strip 200 can wrap around more than one strap 225 to provide comfort.

Alternatively, the detachable strip 200 is also wrapped around the at least one strap 225 for decorative purposes. Typically, the detachable strip 200 varies in color and size. In some embodiments, patterns can be imprinted and/or drawn on the detachable strip 200 to vary the appearance. In other embodiments, the plurality of detachable strips 200 can also wrap around the at least one strap 225 to further add aesthetic value. Yet, in other embodiments, the detachable strip 200 can wrap around more than one strap 225 to add aesthetic value.

Figure 2E:
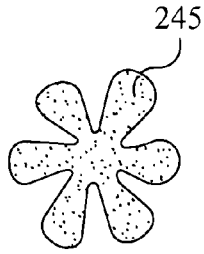
FIG. 2E illustrates a backside of a decorative accessory.

Referring back to FIG. 2C, a decorative accessory piece 230 can likewise be attached to the detachable strip 200 for further styling the footwear. Typically, the decorative accessory piece 230 varies in color, pattern, shape, and appearance, and is made of material such as fabric, plastic, leather, metal, and wood. For instance, the decorative accessory piece 230 can be jewelry, a sticker, a bow, a flower, or a school emblem or mascot. Preferably, the decorative accessory piece 230 has a hooks backing 245, as illustrated in FIG. 2E, to attach to the loops on the second side 220 of the detachable strip 200. As such, the decorative accessory piece 230 is removable and reusable. A plurality of decorative accessory piece 230 can also be attached to the detachable strip 200 to 'liven up' the footwear.

Figure 2F:
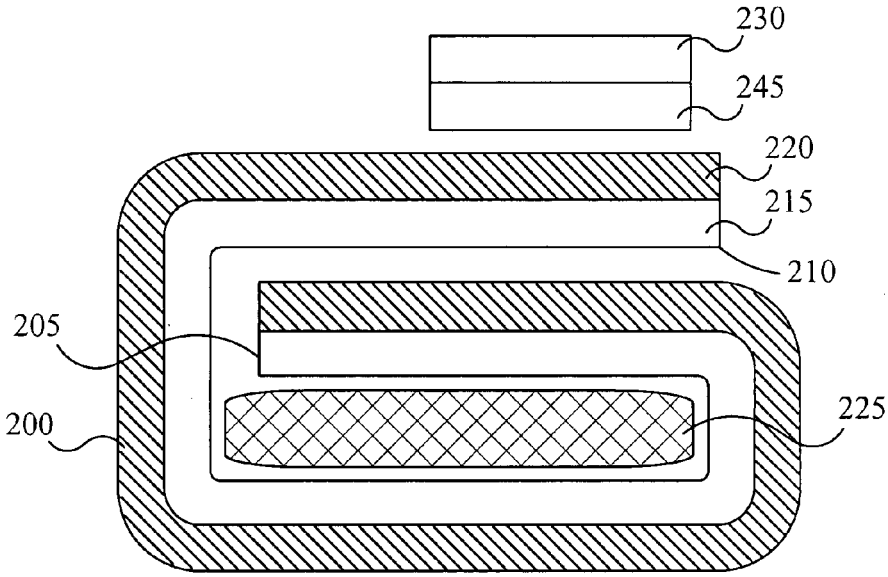
FIG. 2F illustrates a cross-sectional view of the first embodiment of the present invention attached to a footwear strap.

FIG. 2F illustrates a cross-section view of the decorative accessory piece 230 on the detachable strip 200 wrapped around the at least one strap 225 of the footwear. As explained above, the second end 210 of the detachable strip 200 is the looping end and attaches to the first end 205. The second side 220 facing outwards provides a comfortable surface against the foot and allows direct attachment of the decorative accessory piece 230.

Similarly, the detachable strip 200 can be used with many different accessories, such as headbands, bracelets, frames of glasses, and the like. For instance, the detachable strip 200 can wrap around a section of the headband to provide optimal comfort and/or aesthetic value.

Figure 3A:
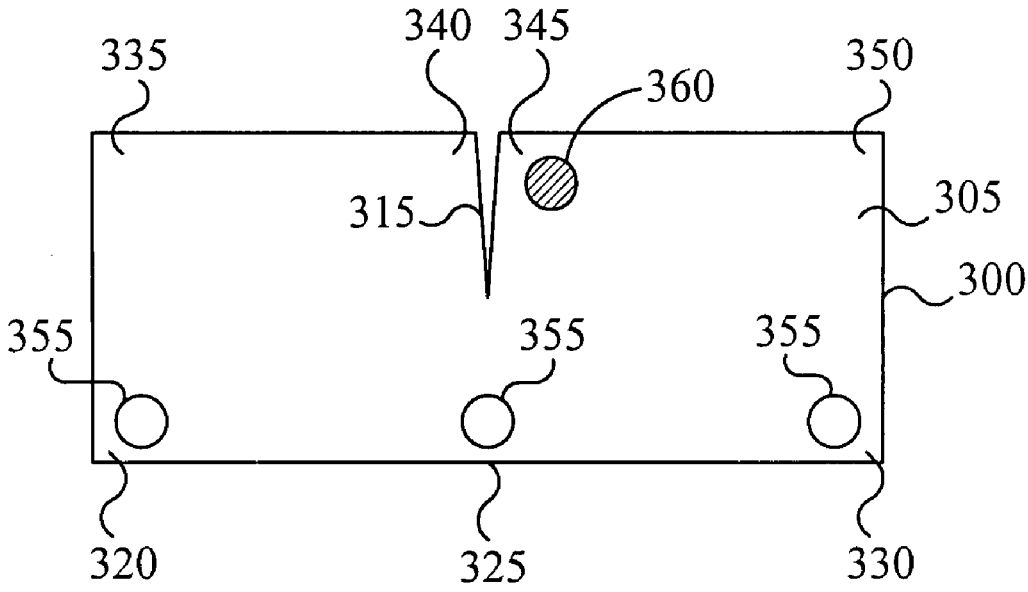
FIG. 3A illustrates a back side of a second embodiment of the present invention.
Figure 3B:
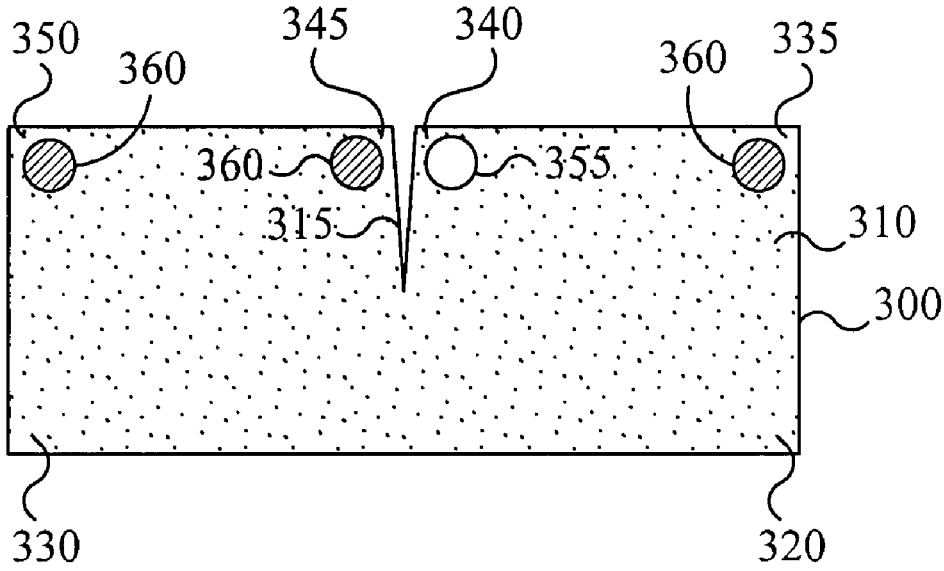
FIG. 3B illustrates a front side of the second embodiment of the present invention.
Figure 3C:
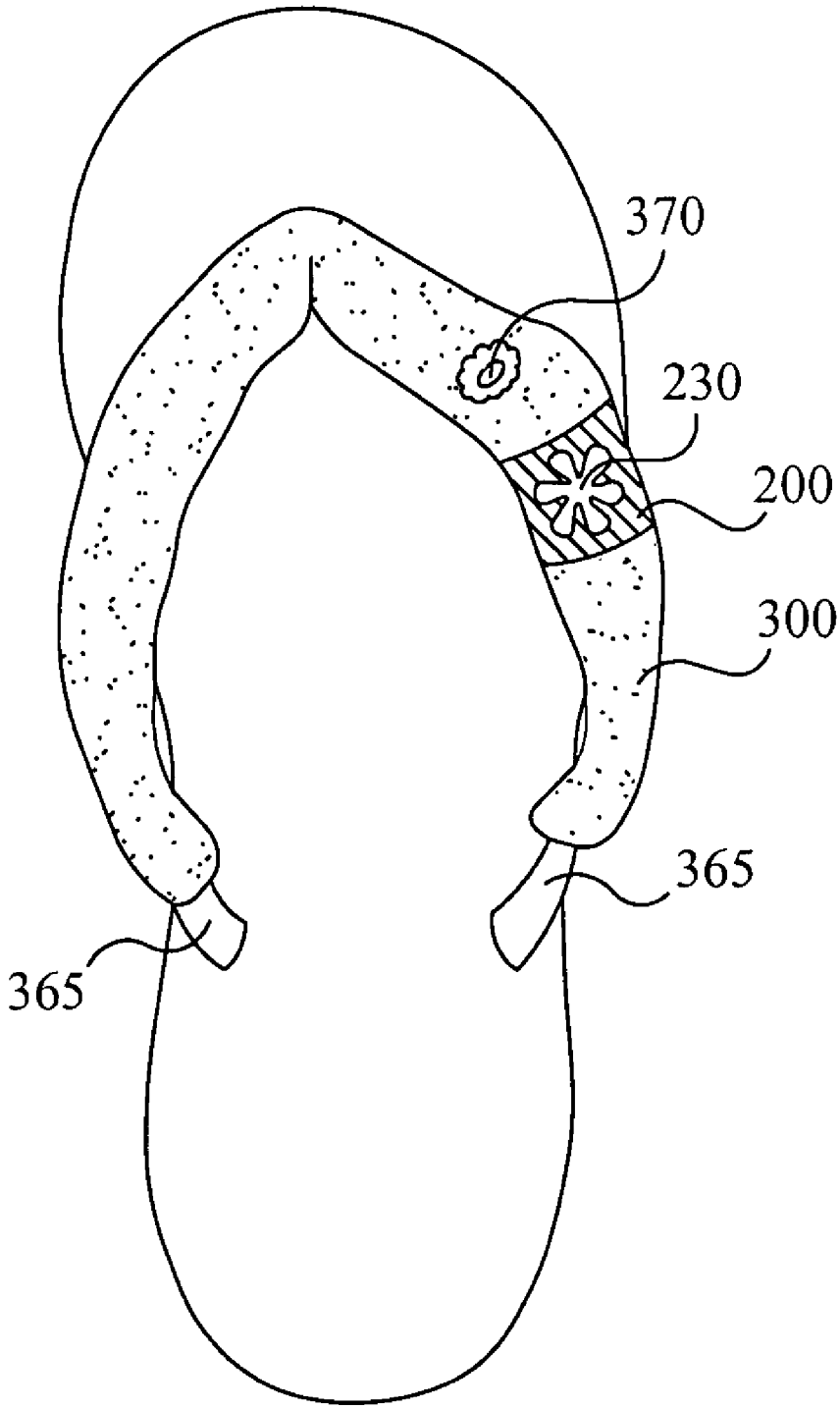
FIG. 3C illustrates a top down view of the second embodiment of the present invention attached to a footwear strap.

FIGS. 3A-3B illustrate another embodiment of the detachable material. The detachable material is a detachable band 300 having a slit, a plurality of hooks and a plurality of loops attached to a front side 310 of the detachable band 300 and to a back side 305 of the band 300. A common form of footwear that the detachable band 300 applies to is a flip flop having a Y-shaped strap 365. Preferably, the band wraps around legs of the Y-shaped strap 365, as illustrated in FIG. 3C. The plurality of hooks and the plurality of loops are attached to the detachable band 300 such that the detachable band 300 can be fastened to itself without visibly displaying the plurality of hooks and the plurality of loops from a top view of the flip flop and without the plurality of hooks and the plurality of loops rubbing against the foot.

Referring back to FIGS. 3A-3B, the detachable band 300 is preferably cut from a single piece of material. Typically, the material provides a soft feel against the foot. Alternatively, the material is a decorative piece of fabric. The material can be made of wool, felt, silk, cotton, or any such comfortable fabric. Alternatively, the material can be of the type having hooks on one face and loops on an opposite face wherein the loop side can be soft. The slit 315 starts from a middle top of the band 300 down to a center of the band 300. As mentioned above, the plurality of hooks 355 and the plurality of loops 360 are placed on a back side 305 of the band 300 and on a front side 310 of the band 300. Preferably, placements on both sides of the band 300 are according to a predetermined arrangement, which allows the detachable band 300 to be easily wrapped around the Y-shaped strap 365 and then subsequently removed. Typically, the band 300 is rectangular in shape, and a width of the band 300 is at least double a width of the Y-shaped strap 365 such that the band 300 is large enough for wrapping around the legs of the Y-shaped strap 365.

FIG. 3A illustrates the back side 305 of the detachable band 300. The predetermined arrangement includes adhering a first of the plurality of hooks 355 on a first bottom corner 320, adhering a second of the plurality of hooks 355 on a bottom middle 325, adhering a third of the plurality of hooks 355 on a second bottom corner 330, and adhering a first of the plurality of loops 360 on a first slit corner 345.

FIG. 3B illustrates the front side 310 of the detachable band 300. The arrangement further includes adhering a second of the plurality of loops 360 on a second top corner 350, adhering a third of the plurality of loops 360 on the first slit corner 345, adhering a fourth of the plurality of hooks 355 on a second slit corner 340, and adhering a fourth of the plurality of loops 360 on a first top corner 335.

Figure 3D:
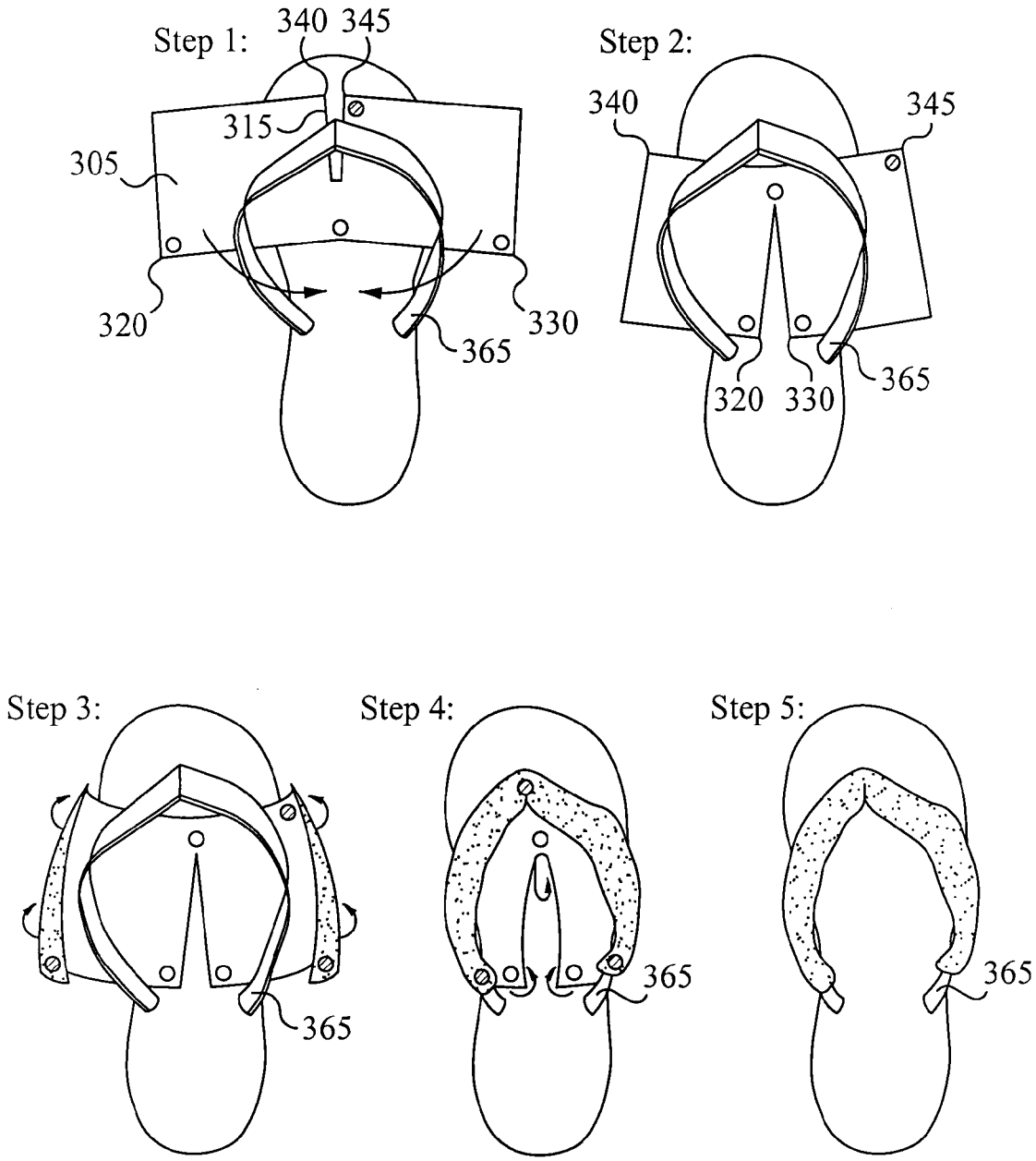
FIG. 3D illustrates a method of wrapping the second embodiment of the present invention around a footwear strap.

FIG. 3D illustrates the manner in which the detachable band 300 is preferably wrapped around the legs of the Y-shaped strap 365. In step 1, the detachable band 300 is placed underneath the legs of the Y-shaped strap 365. Preferably, the slit 315 faces towards a top of the flip flop and the front side faces down. According to arrows in step 1, the first bottom corner 320 and the second bottom corner 330 are pulled inwards toward a middle of the flip flop underneath the Y-shaped strap 365. The first bottom corner 320 and the second bottom corner 330 at the middle of the flip flop creates a standing arch using a bottom side of the detachable band 300, as shown in step 2. The second slit corner 340 and the first slit corner 345 are at opposite ends facing towards the top of the flip flop. In step 3, top sides of the detachable band 300 are folded over outside edges of the Y-shaped strap 365, as indicated by arrows. In step 4, the bottom side of the detachable band 300 is folded over inside edges of the Y-shaped strap 365, as indicated by arrows. In step 5, each of the plurality of hooks 355 is secured to each of the plurality of loops 360. Preferably, step 5 includes attaching the first of the plurality of loops 360 on the back side of the first slit corner 345 to the fourth of the plurality of hooks 355 on the front side of the second slit corner 340, attaching the second of the plurality of hooks 355 at the bottom middle 325 of the back side of the band 300 to the third of the plurality of loops 360 on the front side of the first slit corner 345, attaching the first of the plurality of hooks 355 on the back side of the first bottom corner 320 to the fourth of the plurality of loops 360 on the front side of the first top corner 335, and attaching the third of the plurality of hooks 355 on the back side of the second bottom corner 330 to the second of the plurality of loops 360 on the second top corner 350. The Y-shaped strap 365 of the flip flop wrapped with the detachable band 300 is shown in FIG. 3C. The wrapped detachable band 300 can be unfastened and adjusted until optimal comfort is reached and/or aesthetic value is achieved.

After wrapping the detachable band 300 around the Y-shaped strap 365, the front side 310 of the detachable band 300 typically faces out. The detachable band 300 is an additional layer, which provides comfort and guards against blister formation that would have otherwise been caused by the Y-shaped strap 35 rubbing against the foot while walking or during wear.

Alternatively, the detachable band 300 is also wrapped around the Y-shaped strap 365 for decorative purposes. Typically, the Y-shaped strap 365 varies in size, color, texture, and pattern. In some embodiments, patterns can be imprinted and/or drawn on the detachable band 300 to vary the appearance. In other embodiments, a decorative element 370 can be attached to the detachable band 300 to allow further variation in appearance. In other embodiments, a plurality of decorative elements 370 can be attached to the detachable band 300 to add aesthetic value. The plurality of decorative elements 370 can be permanently attached or can be attached using a "hook and loop" fastener system. In addition, the attachable strip 200 can also be attached on top of the detachable band 300 to allow further versatility of appearance changes.

The present invention has been described in terms of specific embodiments incorporating details to facilitate the understanding of principles of construction and operation of the invention.

Such reference herein to specific embodiments and details thereof is not intended to limit the scope of the claims appended hereto. A person skilled in the art would appreciate that various modifications and revisions to the strap wrap will occur. Consequently, the aims should be broadly construed, consistent with the spirit and scope of the invention, and should not be limited to their exact, literal meaning.

We claim:

1. In a footwear having at least one strap, the improvement comprising a detachable material including imprinted aesthetics thereon, wherein the detachable material has two ends, each end having an end region, and wherein the detachable material is configured to wrap around the at least one strap for optimal comfort and/or aesthetic value, and wherein the detachable material is adjustable such that the two ends are able to couple together anywhere within the end regions, wherein the detachable material is a band having a slit, a plurality of hooks and a plurality of loops coupled to a front side of the band and to a back side of the band, the band configured for wrapping around legs of a Y-shaped strap.

2. The improvement according to claim 1, further comprising a detachable decorative accessory, wherein the detachable decorative accessory is coupled to the detachable material.

3. The improvement according to claim 2, wherein the detachable decorative accessory is a strip made of self-fastening material, the strip comprising a first end and a second end, a portion of the second end is configured to wrap around a section of the at least one strap and couple to a portion of the first end.

4. The improvement according to claim 3, wherein the self-fastening material has hooks on a first side and loops on a second side.

5. The improvement according to claim 1, wherein the at least one strap is a Y-shaped strap.

6. The improvement according to claim 1, wherein the plurality of hooks and the plurality of loops coupled to the band are configured to enable the band to be fastened to the band without visibly displaying the plurality of hooks and the plurality of loops from a top view of the footwear and without the plurality of hooks and the plurality of loops rubbing against a foot.

7. The method of claim 1, wherein the detachable material is adjustable along the at least one strap.

8. A method of wrapping a detachable band to a footwear having a Y-shaped strap comprising:

a. sliding the detachable band underneath legs of the Y-shaped strap, the detachable band having a slit, a plurality of hooks and a plurality of loops coupled to a front side of the band and to a back side of the band, the slit facing toward a top of the footwear and the front side facing down;

b. pulling inwards a first bottom corner of the detachable band and a second bottom corner of the detachable band toward a middle of the footwear, creating a standing arch;

c. folding top sides of the detachable band over outside edges of the Y-shaped strap and folding a bottom side of the detachable band over inside edges of the Y-shaped strap; and d. securing each of the plurality of hooks to each of the plurality of loops.

9. The method of claim 8, wherein the step of securing includes:

a. attaching a first of the plurality of loops on a back side of a first slit corner to a fourth of the plurality of hooks on a front side of a second slit corner;

b. attaching a second of the plurality of hooks at a bottom middle of the back side of the band to a third of the plurality of loops on a front side of the first slit corner;

c. attaching a first of the plurality of hooks on a back side of the first bottom corner to a fourth of the plurality of loops on a front side of the first top corner; and d. attaching a third of the plurality of hooks on a back side of the second bottom corner to a second of the plurality of loops on a front side of the second top corner.

10. The method of claim 8 further comprising coupling a detachable decorative accessory to the detachable band.

11. A method of manufacturing a detachable cover for a footwear having a Y-shaped strap comprising:

a. cutting a band from a piece of material;

b. making a slit from a middle top of the band down to a center of the band; and c. placing a plurality of hooks and a plurality of loops on a back side of the band and on a front side of the band, thereby creating the detachable cover for the footwear having the Y-shaped strap.

12. The method of claim 11, wherein the band is rectangular in shape, comprising a width at least double a width of the Y-shaped strap.

13. The method of claim 11, wherein the step of placing includes:

a. adhering a first of the plurality of hooks on a back side of a first bottom corner;

b. adhering a second of the plurality of hooks on a bottom middle of the back side of the band;

c. adhering a third of the plurality of hooks on a back side of a second bottom corner;

d. adhering a first of the plurality of loops on a back side of a first slit corner;

e. adhering a second of the plurality of loops on a front side of a second top corner;

f. adhering a third of the plurality of loops on a front side of the first slit corner;

g. adhering a fourth of the plurality of hooks on a front side of a second slit corner; and h. adhering a fourth of the plurality of loops on a front side of a first top corner.

* * * * *